US007697863B2

(12) United States Patent
Asahina

(10) Patent No.: US 7,697,863 B2
(45) Date of Patent: Apr. 13, 2010

(54) COOLING SYSTEM FOR ELECTRICAL COMPONENT AND IMAGE FORMING APPARATUS

(75) Inventor: Keita Asahina, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/948,328

(22) Filed: Nov. 30, 2007

(65) Prior Publication Data

US 2008/0240767 A1 Oct. 2, 2008

(30) Foreign Application Priority Data

Mar. 30, 2007 (JP) ..... 2007-094510

(51) Int. Cl.
*G03G 21/20* (2006.01)

(52) U.S. Cl. ..... 399/92; 399/93; 399/98

(58) Field of Classification Search ..... 399/91, 399/92, 93, 98
See application file for complete search history.

(56) References Cited

U.S. PATENT DOCUMENTS 5,771,055 A * 6/1998 Aiba et al. ..... 347/134
6,370,023 B1 * 4/2002 Su ..... 361/679.48
6,459,579 B1 * 10/2002 Farmer et al. ..... 361/695
6,795,315 B1 * 9/2004 Wu et al. ..... 361/695
7,113,402 B2 * 9/2006 Rutledge et al. ..... 361/695
7,167,363 B1 * 1/2007 Cushman et al. ..... 361/694

FOREIGN PATENT DOCUMENTS

JP 2003-316237 A 11/2003
JP 3503923 B2 12/2003

OTHER PUBLICATIONS

English translation of Ohashi, et al. (JP pub 2003-316237).*

* cited by examiner

*Primary Examiner*—David M Gray
*Assistant Examiner*—Geoffrey T Evans
(74) *Attorney, Agent, or Firm*—Sughrue Mion, PLLC

(57) ABSTRACT

A cooling system for an electrical component, comprises: a substrate having a mounting surface on which an electrical component is mounted; an air sucking section that takes in air for cooling the electrical component; a first guide member comprising a first guide surface that leads the air taken into the air sucking section in such a direction as to be separated from the mounting surface of the substrate; and a second guide member comprising a second guide surface that leads, to the mounting surface of the substrate, the air led to the first guide surface.

9 Claims, 6 Drawing Sheets

COOLING SYSTEM FOR ELECTRICAL COMPONENT AND IMAGE FORMING APPARATUS

CROSS-REFERENCE TO RELATED APPLICATIONS

This application is based on and claims priority under 35 USC 119 from Japanese Patent Application No. 2007-094510 filed Mar. 30, 2007.

BACKGROUND (i) Technical Field

The present invention relates to a cooling system for an electrical component and an image forming apparatus.

(ii) Related Art

An image forming apparatus such as a laser printer has a power board (a substrate) on which an electrical component for feeding a power to various apparatuses such as a developing apparatus or a fixing apparatus is mounted on a mounting surface.

A large number of high voltage electrical components such as a transformer are mounted on the power board and serve as heat generating sources. By using a fan in an air suction (that is, by using air sucking section), therefore, air is introduced from an outside to cool them.

When the introduced air hits against the high voltage electrical component, there is a possibility that dust in the air might be locally accumulated in the electrical component to generate an insulating failure. Therefore, a position in which the air does not directly hit against the high voltage component (that is, a secondary side of the high voltage component) is set to be a position of the fan.

However, a layout of the electrical component to be mounted on the substrate is restricted so that the electrical component cannot be disposed freely.

In addition, even if the electrical component which is not the high voltage component is employed, there is a possibility that the insulating failure might be generated in the case in which the dust is accumulated.

SUMMARY

An aspect of the invention is directed to a cooling system for an electrical component, comprising: a substrate having a mounting surface on which an electrical component is mounted; an air sucking section that takes in air for cooling the electrical component; a first guide member comprising a first guide surface that leads the air taken into the air sucking section in such a direction as to be separated from the mounting surface of the substrate; and a second guide member comprising a second guide surface that leads, to the mounting surface of the substrate, the air led to the first guide surface.

BRIEF DESCRIPTION OF THE DRAWINGS

Exemplary embodiments of the present invention will be described in detail based on the following figure, wherein.

DETAILED DESCRIPTION

Figure 1:
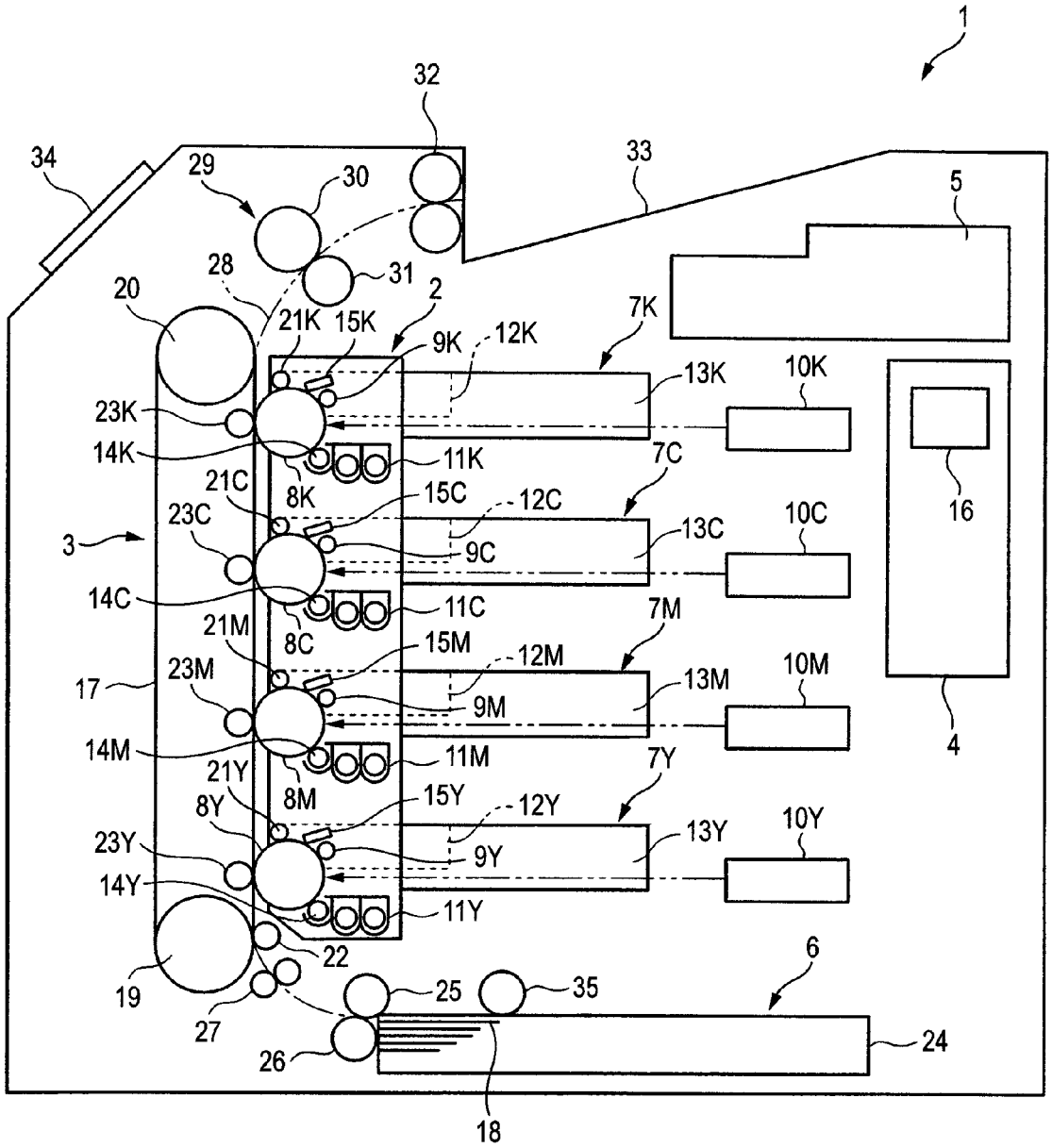
FIG. 1 is a conceptual view showing a full color printer of a tandem type which is an image forming apparatus according to an exemplary embodiment of the invention.

An exemplary embodiment to be an example of the invention will be described below in detail with reference to the drawings. In the drawings for explaining the exemplary embodiment, the same components have the same reference numerals in principle and repetitive description thereof will be omitted.

FIG. 1 is a conceptual view showing a full color printer of a tandem type which is an image forming apparatus according to the exemplary embodiment of the invention. The full color printer is constituted to execute a printing operation based on image data transferred from a personal computer or a scanner, for example. As a matter of course, the image forming apparatus may be constituted as a copying machine or a facsimile having a scanner or a compound machine having the functions.

In FIG. 1, an image forming unit 2 is disposed in a vertical direction in an almost central part in a full color printer body 1 of a tandem type. Moreover, in the full color printer body 1, a paper delivery belt unit 3 for delivering a transfer material to which toner images having a plurality of colors formed by the image forming unit 2 are to be transferred in an adsorbing state is disposed on one of sides of the image forming unit 2 (a left side in the case shown in FIG. 1), and furthermore, a control unit 4 including a control circuit is disposed on the other side of the image forming unit 2 (a right side in the case shown in FIG. 1) and a power circuit unit 5 including a high voltage power circuit is disposed obliquely above the image forming unit 2.

Furthermore, a paper feed cassette 6 for accommodating a paper (sheet) 18 as a recording medium onto which an image is to be transferred and formed and feeding the paper is disposed on a bottom in the full color printer body 1.

The image forming unit 2 includes four image forming portions 7Y, 7M, 7C and 7K for forming toner images having colors of yellow (Y), magenta (M), cyan (C) and black (K) in order from a bottom. The four image forming portions 7Y, 7M, 7C and 7K are disposed in series at a regular interval in a vertical direction.

The four image forming portions 7Y, 7M, 7C and 7K have the same structure except for a color of an image to be formed and, as shown in FIG. 1, are roughly constituted by photosensitive drums 8 (8Y, 8M, 8C, 8K) serving as image holding members to be rotated at predetermined rotating speeds, charging rolls 9 (9Y, 9M, 9C, 9K) for primary charging which serve to uniformly charge the surfaces of the photosensitive drums 8 to predetermined electric potentials, exposing devices 10 (10Y, 10M, 10C, 10K) for exposing images corresponding to the respective colors to form electrostatic latent images on the surfaces of the photosensitive drums 8, developing devices 11 (11Y, 11M, 11C, 11K) for developing the electrostatic latent images formed on the photosensitive drums 8 in toners having the corresponding colors, charge removing devices 21 (21Y, 21M, 21C, 21K) for removing electric charges remaining on the photosensitive drums 8 after a development, cleaning devices 12 (12Y, 12M, 12C, 12K) for cleaning the transfer residual toner remaining on the photosensitive drums 8, and toner cartridges 13 (13Y, 13M, 13C, 13K) for supplying the toner to the developing devices 11.

As shown in FIG. 1, the developing devices 11 are constituted to supply, to developing rolls 14 (14Y, 14M, 14C, 14K), a developer having two components or one component accommodated therein while stirring the developer, to control a layer thickness of the developer supplied to the developing rolls 14, and at the same time, to deliver the developer to developing regions which are opposed to the photosensitive drums 8 and to develop the electrostatic latent images formed on the surfaces of the photosensitive drums 8 in toners having predetermined colors.

Corresponding to the developing devices 11Y, 11M, 11C and 11K having the respective colors of yellow (Y), magenta (M), cyan (C) and black (K), there are provided the toner cartridges 13Y, 13M, 13C and 13K to be developer housing containers for supplying the toners having the respective colors of yellow (Y), magenta (M), cyan (C) and black (K).

Moreover, the charge removing device 21 serves to irradiate a light on the photosensitive drums 8, thereby removing residual electric charges after the development so that a drum surface is uniformly charged in a next image formation.

Furthermore, the cleaning device 12 serves to remove the transfer residual toners remaining on the surfaces of the photosensitive drums 8 by cleaning blades 15 (15Y, 15M, 15C, 15K), and to deliver the transfer residual toners which are removed into the cleaning devices 12 and to accommodate them therein as shown in FIG. 1.

As shown in FIG. 1, the control unit 4 is disposed in the full color printer body 1. The control unit 4 is provided with an image processing device 16 for carrying out a predetermined image processing over image data, for example. Image data having colors of yellow (Y), magenta (M), cyan (C) and black (K) are sequentially output from the image processing device 16 to the exposing device 10 and four laserbeams LB emitted from the exposing device 10 corresponding to image data are scanned and exposed onto the respective photosensitive drums 8Y, 8M, 8C and 8K so that electrostatic latent images are formed. The electrostatic latent images formed on the photosensitive drums 8Y, 8M, 8C and 8K are developed as toner images having the colors of yellow (Y), magenta (M), cyan (C) and black (K) by the developing devices 11Y, 11M, 11C and 11K, respectively.

Moreover, the paper delivery belt unit 3 includes, as a non-end belt, a paper delivery belt 17 to be circulated and moved as shown in FIG. 1. The paper delivery belt 17 is constituted to deliver, in an electrostatic adsorbing state, the paper 18 to be a transfer material onto which the toner images having the colors of yellow (Y), magenta (M), cyan (C) and black (K) formed by the image forming portions 7Y, 7M, 7C and 7K are to be transferred.

As shown in FIG. 1, the paper delivery belt 17 is laid in a predetermined tension between a driving roll 19 to be a stretch roll disposed in a vertical direction and a driven roll 20, and is constituted to be circulated and moved counterclockwise in FIG. 1 at a predetermined speed by means of the driving roll 19 to be rotated and driven by a driving motor which is not shown.

A distance between the driving roll 19 and the driven roll 20 is set to be almost equal to a length of the paper 18 having an A3 size, for example, and is not restricted thereto but it is a matter of course that the distance may be optionally set. Moreover, a synthetic resin film such as polyimide having a flexibility which is formed like a non-end belt is used for the paper delivery belt 17, for example.

Furthermore, an adsorbing roll 22 for electrostatically adsorbing the paper 18 onto the surface of the paper delivery belt 17 is disposed to abut on the surface of the driving roll 19 through the paper delivery belt 17 as shown in FIG. 1. For example, the adsorbing roll 22 is constituted to cover a surface of a metallic cored bar with a conductive rubber in the same manner as the charging rolls 9 of the image forming portions 7Y, 7M, 7C and 7K, and a predetermined bias voltage for adsorption is applied to the metallic cored bar. The adsorbing roll 22 has such a structure as to electrostatically charge the paper 18 fed from the paper feeding cassette 6 and to adsorb the paper 18 onto the surface of the paper delivery belt 17. The adsorbing roll 22 does not need to be always provided.

The toner images having the colors of yellow (Y), magenta (M), cyan (C) and black (K) which are formed on the photosensitive drums 8Y, 8M, 8C and 8K of the image forming portions 7Y, 7M, 7C and 7K are transferred sequentially and multiply in a superposing state through transfer rolls 23Y, 23M, 23C and 23K onto the paper 18 delivered in a state in which it is adsorbed onto the surface of the paper delivery belt 17. The transfer rolls 23Y, 23M, 23C and 23K are attached integrally with the paper delivery belt unit 3.

As shown in FIG. 1, the paper 18 is fed from the paper feeding cassette 6 disposed in a bottom portion of the printer body 1 and is delivered to the printer body 1. The paper feeding cassette 6 includes a paper tray 24 in which the papers 18 having desirable sizes and formed by desirable materials are accommodated. Moreover, a pickup roll (a recording medium take-out section) 35 to be nipped with the paper 18 positioned in an uppermost part is disposed on the paper tray 24. Consequently, the papers 18 having the desirable sizes and formed by the desirable materials are taken out of the paper tray 24 one by one by means of the pickup roll 35 and are fed by means of a paper feeding roll 25, and furthermore, are fed in a state in which they are separated one by one by means of a separating roll 26 and are delivered to the adsorbing position on the paper delivery belt 17 in a predetermined timing through a resist roll 27 to be a paper feeding section.

The paper feeding roll 25 and the pickup roll 35 are provided on the full color printer body 1 side, and the separating roll 26 is provided on the paper feeding cassette 6 side.

It is also possible to use a roll having the function of the pickup roll 35 and that of the feeding roll 25 integrally. Moreover, it is also possible to use a separating section of a pad type which has a predetermined frictional resistance to the paper 18 which is taken out in place of the separating roll 26.

For the recording medium, there are used sheet-like members having various sizes, for example, an A4 size, an A3 size, a B5 size or a B4 size and formed by various materials, for example, a plain paper, a thick paper such as a coat paper, or an OHP sheet.

As shown in FIG. 1, the paper 18 onto which the toner images having the colors of yellow (Y), magenta (M), cyan (C) and black (K) are multiply transferred is separated from the paper delivery belt 17 through a rigidity (a so-called stiffness) possessed by the paper 18 itself and is then delivered to a fixing device 29 along a delivery path 28. Thereafter, a heat and a pressure are applied to the paper 18 in the fixing device 29 so that the toner image is fixed onto the paper 18.

The paper delivery belt 17 and the fixing device 29 are disposed close to each other, and the paper 18 separated from the paper delivery belt 17 is delivered to the fixing device 29 by a delivering force of the paper delivery belt 17. The fixing device 29 is constituted to be rotated and driven in a state in which a heating roll 30 and a pressurizing belt 31 are caused to come in pressure contact with each other, and to cause the paper 18 to pass through a nip portion formed between the heating roll 30 and the pressurizing belt 31, thereby carrying out a fixing treatment by the heat and pressure.

Subsequently, the paper 18 onto which the toner images having the respective colors are fixed is discharged, by means of a discharge roll 32, onto a discharge tray 33 provided on an upper part of the full color printer body 1 with a printed surface turned downward, and the printing operation is thus ended.

In the full color printer, it is possible to print an image having a desirable color such as a monochrome in addition to a full-colored image. Toner images are formed by all or a part of the image forming portions 7Y, 7M, 7C and 7K for yellow (Y), magenta (M), cyan (C) and black (K) corresponding to a color of an image to be printed.

In FIG. 1, the reference numeral 34 denotes an operation panel including a display portion such as a liquid crystal panel which is attached to a front surface of the printer body 1. The operation panel 34 is constituted to display a state of the printer and to carry out a necessary operation.

Next, description will be given to a cooling system for an electrical component in the full color printer of a tandem type which has the structure.

Figure 2:
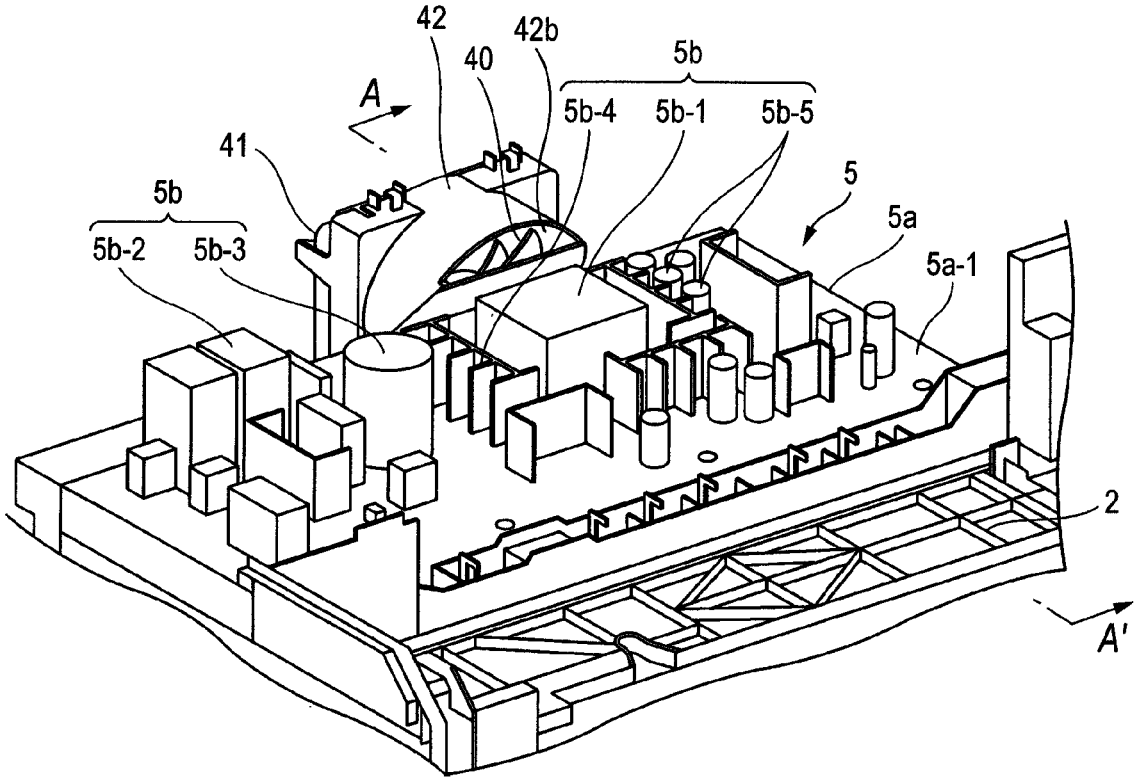
FIG. 2 is a perspective view showing a cooling system for an electrical component according to the exemplary embodiment of the invention.
Figure 3:
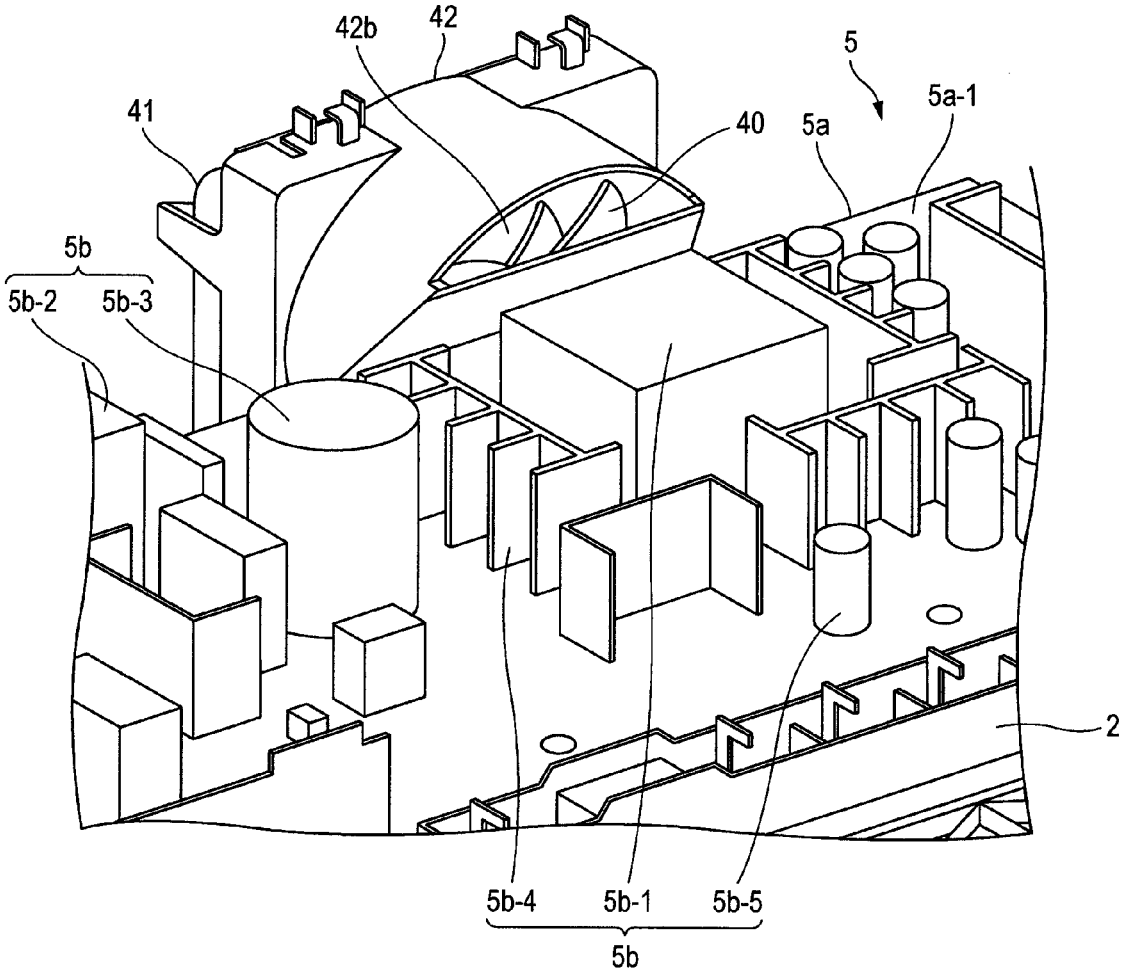
FIG. 3 is a perspective view showing an enlarged main part in FIG. 2.
Figure 4:
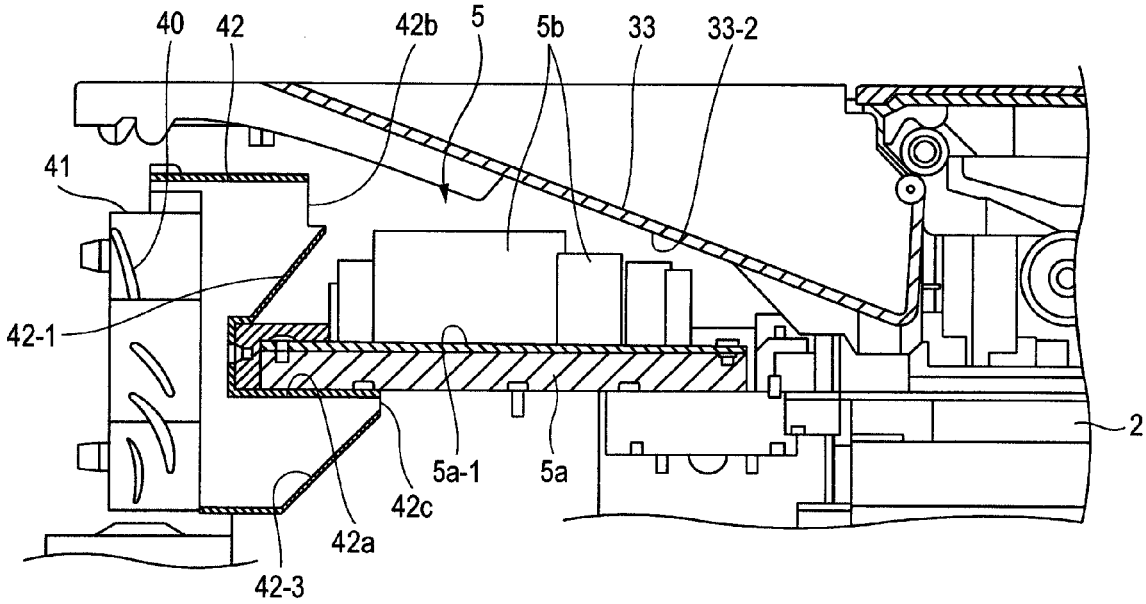
FIG. 4 is a sectional view taken along an A-A' line in FIG. 2.
Figure 5:
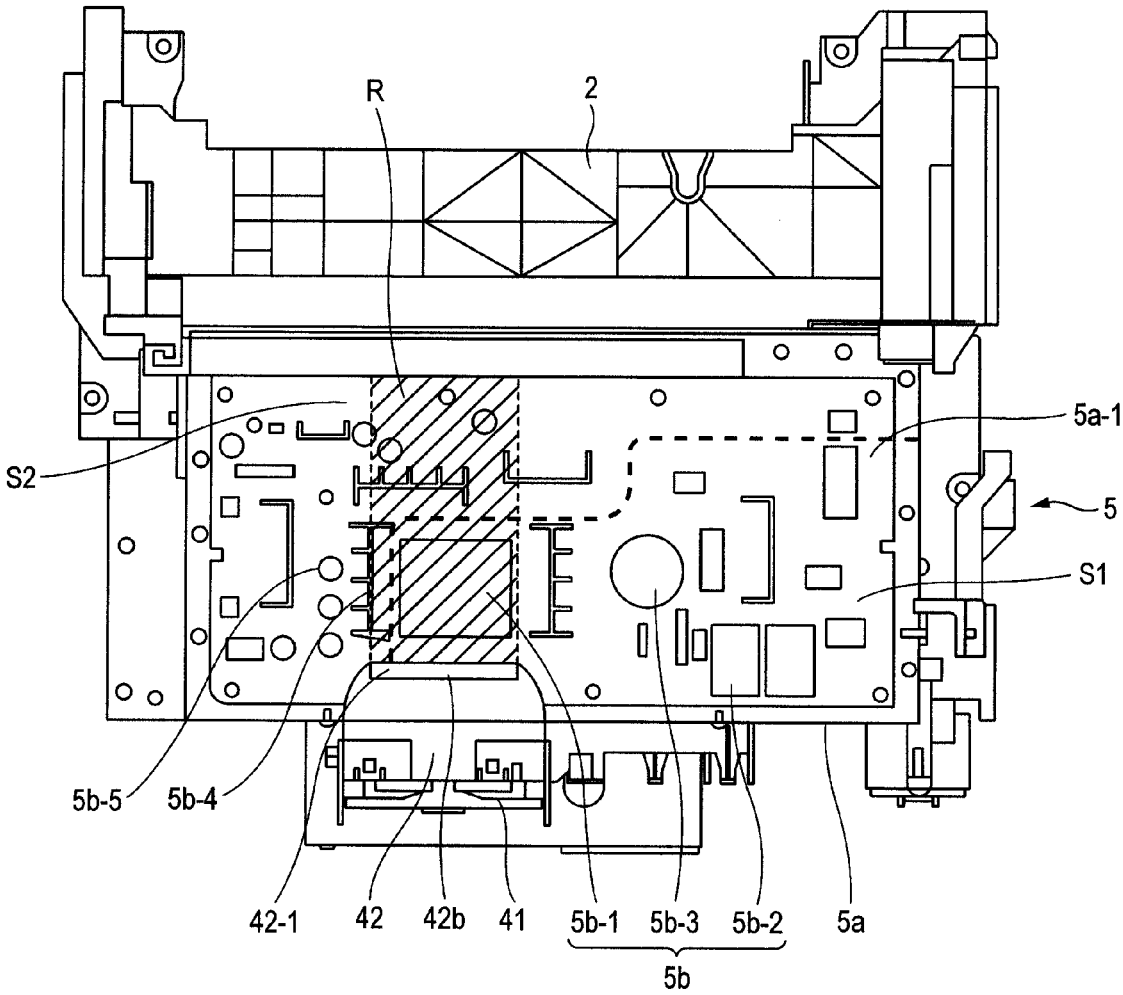
FIG. 5 is a plan view of FIG. 2.
Figure 6:
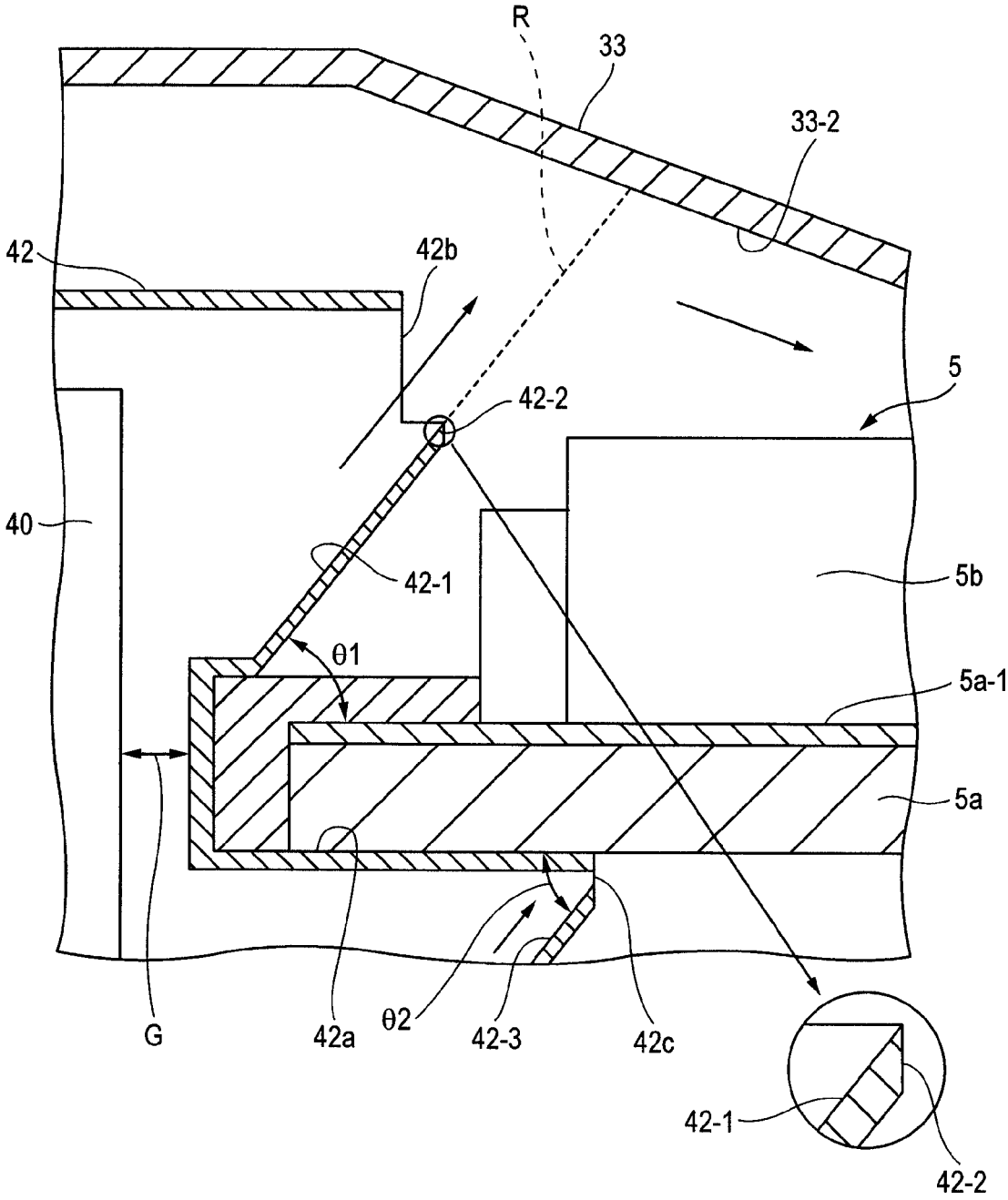
FIG. 6 is a sectional view showing an enlarged main part in FIG. 4.

FIG. 2 is a perspective view showing a cooling system for an electrical component according to an exemplary embodiment of the invention, FIG. 3 is a perspective view showing an enlarged main part of FIG. 2, FIG. 4 is a sectional view taken along an A-A' line in FIG. 2, FIG. 5 is a plan view of FIG. 2, and FIG. 6 is a sectional view showing an enlarged main part of FIG. 4.

The power circuit unit 5 forming a part of the cooling system for an electrical component according to the exemplary embodiment is disposed under the discharge tray (the second guide member) 33 which is tilted upward in a direction of discharge of the paper 18 (FIG. 4), and has a rigid power board (substrate) 5*a* in which a predetermined pattern wiring is formed on a base material having an insulating property as shown in FIGS. 2 and 3. For example, electrical components 5*b* such as a power transistor 5*b*-1, a relay 5*b*-2, a large capacitor 5*b*-3, a heat sink 5*b*-4 and a capacitor 5*b*-5 are mounted on a mounting surface 5*a*-1 of the power board 5*a*.

An air sucking fan (air sucking section) 40 for taking in air for cooling the electrical component 5*b* mounted on the power board 5*a* is accommodated in a housing 41 in a state in which it faces a slit (not shown) formed on a housing of the printer body 1 and is thus disposed in the vicinity of the power board 5*a*. Moreover, a duct (a first guide member) 42 for guiding the air taken in by the air sucking fan 40 is attached between the air sucking fan 40 and the power board 5*a*.

As shown in FIGS. 2 to 5, electrical components which are operated at a high voltage of approximately AC 100 to 230 V and of which heat generating temperature in the operation reaches approximately 70 to 100° C., for example, the power transistor 5*b*-1, the relay 5*b*-2 and the large capacitor 5*b*-3 are loaded into a primary side region S1 of the mounting surface 5*a*-1. Moreover, electrical components which are operated at a high voltage of approximately AC 3.5 to 12 V and of which heat generating temperature in the operation reaches approximately 10 to 30° C., for example, the capacitor 5*b*-5 and a transistor are loaded into a secondary side region S2 of the mounting surface 5*a*-1. The air sucking fan 40 is disposed in the vicinity of the primary side region S1.

As shown in FIGS. 4 and 6, the duct 42 is provided with a step portion 42*a* formed by a horizontal plane passing through an almost rotating center of the air sucking fan 40, and the power board 5*a* is fixed across the step portion 42*a* and the image forming unit 2. In the duct 42, air discharge ports 42*b* and 42*c* are partitioned vertically by the step portion 42*a*. Accordingly, the air taken into the air sucking fan 40 is branched by the step portion 42*a* and is thus discharged from the air discharge port 42*b* and the air discharge port 42*c*.

In the exemplary embodiment, a clearance G (FIG. 6) having a size of approximately 10 mm is formed between the air sucking fan 40 and the duct 42 portion which is positioned on the power board 5*a* side of the air sucking fan, for example. This is provided for preventing an air cutting sound. If the clearance is not provided between the air sucking fan 40 and the same portion, a turbulence is generated so that the air cutting sound is made. If the clearance G is formed, however, the turbulence is not generated. Consequently, the air cutting sound is prevented from being caused by the turbulence. A width of the clearance G is not restricted to be 10 mm but can be set freely. In general, it can be supposed that the air cutting sound is not generated if the width is 10 to 20 mm.

As shown in detail in FIG. 6, the duct 42 is provided with a first guide surface 42-1 for feeding the taken air to the air discharge port 42*b* positioned on the mounting surface 5*a*-1 side and a third guide surface 42-3 for feeding the taken air to the air discharge port 42*c* positioned on an opposite side to the mounting surface 5*a*-1.

The first guide surface 42-1 is extended in an oblique and upward direction of the mounting surface 5*a*-1, and an inclination angle (an acute angle) θ1 to the mounting surface 5*a*-1 is set to be 60 degrees. Accordingly, the direction of the discharge of the air which is taken from the air sucking fan 40 to the duct 42 and is discharged from the air discharge port 42*b* is led by the first guide surface 42-1 and is thus set to be a direction which is separated from the mounting surface 5*a*-1.

Moreover, the third guide surface 42-3 is extended toward an opposite side to the mounting surface 5*a*-1 of the power board 5*a*, and an inclination angle (an acute angle) θ2 to the opposite surface is set to be 60 degrees. Accordingly, the direction of the discharge of the air which is taken from the air sucking fan 40 to the duct 42 and is discharged from the air discharge port 42*c* is led by the third guide surface 42-3 and is thus turned toward the opposite side to the mounting surface 5*a*-1.

The inclination angles of the first and third guide surfaces 42-1 and 42-3 are not restricted to the angles according to the exemplary embodiment but can be set to be free inclination angles such as 45 to 60 degrees, for example. It is preferable that the first guide surface 42-1 should be set to have such an inclination angle that the air discharged from the air discharge port 42*b* does not directly hit against the loaded electrical component 5*b* as will be described below.

As described above, the power circuit unit 5 is disposed under the discharge tray (the second guide member) 33. Therefore, a second guide surface 33-2 to be a back face of the discharge tray 33 is positioned above the power circuit unit 5.

As shown, the second guide surface 33-2 covers the mounting surface 5*a*-1 in such a position that it is exposed to the air discharged from the air discharge port 42*b* of the duct 42, and is inclined to approach the mounting surface 5*a*-1 toward an opposite side to the duct 42.

Accordingly, the air led to the first guide surface 42-1 and discharged from the air discharge port 42*b* of the duct 42 toward the second guide surface 33-2 hits against the second guide surface 33-2 and is thus diffused, and furthermore, is led to the mounting surface 5*a*-1 of the power board 5*a* and cools the electrical component 5*b* mounted on the mounting surface 5*a*-1.

The electrical component 5*b* mounted on the power board 5*a* is mounted in such a range as not to interfere with a surface R (see FIGS. 5 and 6) including the first guide surface 42-1 and extended from the first guide surface 42-1 toward the second guide surface 33-2.

As shown in detail in FIG. 6, the first guide surface 42-1 and an end face 42-2 which is adjacent to an air discharge end of the first guide surface 42-1 are formed at an acute angle. By such a shape, it is possible to suppress the generation of a vortex flow in which the air led to the first guide surface 42-1 is slightly turned round toward the end face 42-2 side at the air discharge end of the first guide surface 42-1. Therefore, a larger amount of air can be led to the second guide surface 33-2.

As shown in FIG. 6 through an extraction, moreover, the air discharge port 42*b* of the duct 42 is cut away to be opened toward the second guide surface 33-2. Without the shape of the nick, the air discharge port is narrowed so that a pressure loss is increased, resulting in a reduction in an air quantity. With the shape, it is possible to sufficiently ensure an opening area of the air discharge port 42*b*. As a result, it is possible to maintain a necessary air quantity.

In the cooling system according to the exemplary embodiment, as described above, the air taken into the air sucking fan 40 is led in such a direction as to be separated from the mounting surface 5*a*-1 of the power board 5*a* by means of the first guide surface 42-1 of the duct 42. The air led to the first guide surface 42-1 hits against the second guide surface 33-2 to be a back face of the discharge tray 33 and is thus diffused, and is then led to the mounting surface 5*a*-1 of the power board 5*a*, thereby cooling the electrical component 5*b*.

Irrespective of a place in which the air sucking fan 40 is to be disposed, accordingly, dust in the air is not locally accumulated on the electrical component 5*b* in a specific position, for example, the vicinity of the air sucking fan 40 but is widely accumulated on the power board 5*a* or the electrical component 5*b* which is mounted. Irrespective of a layout position of the electrical component 5*b* mounted on the power board 5*a*, therefore, an insulating failure can be prevented from being caused by the accumulation of the dust.

Since the generation of the insulating failure in the electrical component 5*b* can be thus suppressed, moreover, the electrical component 5*b* having a comparatively large amount of heat generation, for example, a high voltage component can be disposed in the vicinity of the air sucking fan 40. Therefore, it is possible to enhance a degree of freedom in the case in which the electrical component 5*b* is to be disposed on the power board 5*a*.

When the dust in the air is widely accumulated on the electrical component 5*b*, furthermore, a cooling unevenness of the electrical component 5*b* is relieved. Consequently, it is possible to simplify the heat sink which is to be attached to the electrical component 5*b*.

In the exemplary embodiment, particularly, the electrical component is mounted in such a range as not to interfere with the surface including the first guide surface 42-1 and extended from the first guide surface 42-1 toward the second guide surface 33-2. Therefore, the air which is led toward the second guide surface 33-2 through the first guide surface 42-1 and has not been diffused does not hit against the electrical component 5*b*. Consequently, the local accumulation of the dust in the specific electrical component 5*b* can be prevented still more effectively so that the generation of the insulating failure can be suppressed more reliably.

By using the cooling system for the electrical component in the image forming apparatus, it is possible to prevent the insulating failure from being caused by the accumulation of the dust in the electrical component 5*b* mounted on the power board 5*a*. Thus, it is possible to obtain an image forming apparatus having a high reliability.

Although the discharge tray 33 is applied to the second guide member and the back face of the discharge tray 33 is applied to the second guide surface 33-2, and the power board 5*a* is disposed under the discharge tray 33 in the exemplary embodiment in which the cooling system is applied to the image forming apparatus, it is not necessary to always employ the structure.

By employing the structure, it is possible to dispose the electrical component 5*b* having a great height on the air sucking fan 40 side. Consequently, it is possible to efficiently dispose the electrical component 5*b* on the power board 5*a*.

In the description, the cooling system for the electrical component according to the invention is applied to the image forming apparatus. In an apparatus other than the image forming apparatus, similarly, the cooling system can be widely applied to be a cooling system for an electrical component mounted on a substrate.

Moreover, the electrical component is not restricted to be mounted on the power board but can be applied to components mounted on various types of substrates.

What is claimed is:

1. An image forming apparatus comprising:

a cooling system for an electrical component, comprising:

a substrate having a mounting surface on which an electrical component is mounted;

an air sucking section that takes in air for cooling the electrical component;

a first guide member comprising a first guide surface which directs the air taken in by the air sucking section away from the mounting surface of the substrate; and a second guide member comprising a second guide surface that directs the air that has been directed by the first guide surface to the mounting surface of the substrate, wherein a line extending from the mounting surface in a perpendicular direction from the mounting surface intersects with the second guide surface, wherein the mounting surface faces the second guide surface, and wherein the first guide surface extends in an oblique angle relative to the mounting surface of the substrate.

2. The cooling system for an electrical component according to claim 1, wherein the electrical component is mounted on the substrate in such a range as not to interfere with a surface including the first guide surface and extended from the first guide surface toward the second guide surface.

3. The cooling system for an electrical component according to claim 1, wherein a clearance is formed between the air sucking section and a substrate side of the air sucking section.

4. The cooling system for an electrical component according to claim 1, wherein the first guide surface and an end face which is adjacent to an air discharge end of the first guide surface are formed at an acute angle.

5. The cooling system for an electrical component according to claim 1, wherein the first guide member comprises an air discharge port that discharges the air directed to the second guide surface, and the air discharge port is cut away to be opened toward the second guide surface.

6. The cooling system for an electrical component according to claim 1, wherein the air that is directed by the first guide surface contacts the second guide surface and is diffused such that dust in the air is prevented from locally accumulating on the electrical component.

7. The cooling system for an electrical component according to claim 1, wherein the second guide surface extends in an oblique angle relative to the mounting surface of the substrate and is inclined to approach the mounting surface of the substrate along a flow direction of the air.

8. The cooling system for an electrical component according to claim 1, wherein the oblique angle at which the first guide surface extends relative to the mounting surface of the substrate is in a range of 45 to 60 degrees.

9. An image forming apparatus comprising:

a cooling system for an electrical component, comprising:

a substrate having a mounting surface on which an electrical component is mounted;

an air sucking section that takes in air for cooling the electrical component;

a first guide member comprising a first guide surface which directs the air taken in by the air sucking section away from the mounting surface of the substrate; and a second guide member comprising a second guide surface that leads the air that has been directed by the first guide surface, to the mounting surface of the substrate;

wherein the second guide member is a discharge tray that discharges a sheet on which an image is formed and the second guide surface is a back face of the discharge tray, and the substrate is disposed under the discharge tray.

* * * * *